US005287242A

United States Patent [19]

Kamimura

[11] Patent Number: 5,287,242

[45] Date of Patent: Feb. 15, 1994

[54] DEGAUSSING APPARATUS

[75] Inventor: Shigemasa Kamimura, Chiba, Japan

[73] Assignee: Sony Corporation, Tokyo, Japan

[21] Appl. No.: 872,347

[22] Filed: Apr. 23, 1992

[30] Foreign Application Priority Data

May 1, 1991 [JP] Japan ..... 3-128351

[51] Int. Cl.[5] ..... H01F 13/00

[52] U.S. Cl. ..... 361/150; 315/8

[58] Field of Search ..... 361/139, 143, 146, 149, 361/150; 315/8

[56] References Cited

U.S. PATENT DOCUMENTS 4,380,716 4/1983 Romeo et al. ..... 315/8
4,607,310 8/1986 Channel et al. ..... 361/149
4,636,911 1/1987 Truskalo ..... 361/150
4,829,214 5/1989 Lendaro ..... 361/150

*Primary Examiner*—Jeffrey A. Gaffin
*Attorney, Agent, or Firm*—Lewis H. Eslinger; Jay H. Maioli

[57] ABSTRACT

A predetermined rush current is set by a current setting switch (25). A digital-to-analog (D/A) converter (27) multiplies an attenuation curve signal input thereto from a read-only memory (ROM) (28) and the rush current thus set by the current setting switch (25) with each other and outputs a multiplied output to a D/A converter (29). The D/A converter (29) multiplies a signal input thereto from the D/A converter (27) and a sine wave signal read out from a ROM (30) and output a multiplied output to a field effect transistor (FET) (22) through an operational amplifier (24) to thereby control a degaussing current flowing through a degaussing coil (5). Therefore, a stable degaussing effect can be reproduced.

7 Claims, 4 Drawing Sheets

DEGAUSSING APPARATUS

BACKGROUND OF THE INVENTION

1. Field of the Invention

The present invention relates generally to degaussing apparatus and, more particularly to a degaussing apparatus for use in television receivers, computer display devices or the like.

2. Description of the Prior Art

In television receivers, an electron beam is caused to misland on a phosphor 1 due to an influence of terrestrial magnetism as shown in FIG. 1. As a result, a color mis-registration or the like occurs. In order to avoid the color mis-registration, the television receiver incorporates therein a series circuit of a degaussing coil 5 and a posistor 4 as shown in FIG. 2. The degaussing coil 5 is located at the rear surface of a cathode ray tube (CRT), though not shown. When an AC power source 3 is coupled to this series circuit, there is flowed a current of sine wave whose envelope is gradually attenuated as shown in FIG. 3. That is, when the series circuit is actuated, the resistance value of the posistor 4 is small. However, the posistor 4 generates heats in accordance with a lapse of time and the resistance value thereof is increased gradually with the result that a flowing current through the posistor 4 is attenuated gradually. Then, no current is flowed at an equilibrium temperature.

By flowing such attenuating current to the degaussing coil 5, the magnetism can be transferred to metal covers (magnetic shields) mounted to the inside and outside of the CRT and a shadow mask (aperture grill) so as to cancel the terrestrial magnetism out.

The degaussing circuit incorporated within the television receiver can perform the degaussing operation immediately after the AC power source 3 is coupled thereto and cannot perform the degaussing operation at an arbitrary timing under the condition that it is still supplied with power. This degaussing operation must be carried out prior to various adjustments in the production line of television receivers, for example. Therefore, in such production line, in order to perform the degaussing operation at an arbitrary timing under the condition that the degaussing circuit is powered, such a degaussing apparatus is proposed, in which a television receiver body is provided with terminals 7 and an external posistor 8 can be coupled to the terminals 7 from the outside. When the external posistor 8 is coupled to the terminal 7 at a predetermined timing as described above, no current is substantially flowed to the incorporated posistor 4 because the impedance of the posistor 4 is already increased very much. Accordingly, if the external posistor 8 is coupled to the terminal 7, then the attenuating current shown in FIG. 3 is flowed through the external posistor 8 and hence the degaussing operation is carried out.

Further, a degaussing apparatus shown in FIG. 5 is known. In this example of the prior-art degaussing apparatus, a circuit 10 is coupled to the degaussing coil 5. As shown in FIG. 5, the circuit 10 comprises a diode bridge circuit 11 driven by a power transistor 12, a current detecting resistor 13 for detecting a current flowing through the power transistor 12, a low-pass filter 14 for smoothing the output of the current detecting resistor 13 and feeding the smoothed output back to a DC amplifier 15 and an analog attenuating waveform generator circuit 16 for supplying an analog attenuating waveform signal to the DC amplifier 15.

The attenuating waveform generator circuit 16 is constructed by a differentiating circuit or the like in an analog fashion and generates an analog attenuating waveform which is then fed to the DC amplifier 15. The DC amplifier 15 drives the power transistor 12 in response to the attenuating waveform input thereto from the attenuating waveform generator circuit 16 so that, when a positive half wave is supplied from the AC power source 3, for example, a current is flowed by way of a loop formed of the AC power source 3, the degaussing coil 5, the diode bridge circuit 11, the power transistor 12, the current detecting resistor 13, the diode bridge circuit 11 and the AC power source 3, in that order. Whereas, when a negative half wave is supplied from the AC power source 3, then a current is flowed by way of a loop formed of the AC power source 3, the diode bridge circuit 11, the power transistor 12, the current detecting resistor 13, the diode bridge circuit 11, the degaussing coil 5 and the AC power source 3, in that order.

The current detecting resistor 13 generates a voltage corresponding to a current flowing therethrough and outputs the same to the low-pass filter 14. The low-pass filter 14 smoothes the voltage input thereto from the current detecting resistor 13 and feeds the voltage thus smoothed back to the DC amplifier 15. The DC amplifier 15 drives the power transistor 12 in response to a difference between the analog attenuating waveform signal input thereto from the attenuating waveform generator circuit 16 and the signal input thereto from the low-pass filter 14, thereby a servo operation being effected so that the current flowing through the power transistor 12 becomes equal to the attenuating waveform generated from the attenuating waveform generator circuit 16. Accordingly, the attenuating waveform generating circuit 16 generates a waveform similar to the attenuating current flowing through the posistor 4, for thereby carrying out the degaussing operation.

However, the conventional degaussing apparatus shown in the example of FIG. 4 must prepare the external posistor 8 whose characteristic is the same as that of the posistor 4 incorporated within the television receiver. As a result, this conventional degaussing apparatus cannot cope with the production line in which many kinds of video apparatus such as television receivers or the like are produced.

Further, in the example of the conventional degaussing apparatus shown in FIG. 5, since the reference waveform generated by the attenuation waveform generating circuit 16 is the analog envelope waveform, it is impossible to prepare this analog envelope waveform for a wide variety of apparatus. Also, since this analog envelope waveform is different from a waveform which results from full-wave-rectifying an attenuation waveform flowing through the current detecting resistor 13 in actual practice, the low-pass filter 14 is required. As a consequence, the attenuation waveform flowing through the degaussing coil 5 in actual practice becomes different from the attenuation waveform flowing through the degaussing coil via the posistor 4. Furthermore, it is impossible to set the rush current, which is provided immediately after the degaussing operation is started, to a reference value previously set.

In addition, since the starting timing of the rush current is not specified in any of the above-mentioned two systems of the conventional degaussing apparatus, a reproducibility of degaussing effect is poor.

OBJECTS AND SUMMARY OF THE INVENTION

Therefore, it is an object of the present invention to provide an improved degaussing apparatus in which the aforesaid shortcomings and disadvantages encountered with the prior art can be eliminated.

More specifically, it is an object of the present invention to provide a degaussing apparatus which can cope with many kinds of apparatus.

Another object of the present invention is to provide a degaussing apparatus in which a degaussing time can be reduced.

Still another object of the present invention is to provide a degaussing apparatus in which productivity of production line can be increased.

A further object of the present invention is to provide a degaussing apparatus which can generate a degaussing current having less distortion.

A still further object of the present invention is to provide a degaussing apparatus in which a constant degaussing effect can be reproduced constantly even when the degaussing apparatus is repeatedly utilized.

According to an aspect of the present invention, a degaussing apparatus is comprised of a first memory for storing therein a signal of an attenuation curve, a second memory for storing therein a signal of a sine wave, a multiplying circuit for multiplying the signal of attenuation curve output from the first memory and the sine wave signal output from the second memory, and a driving circuit for driving a degaussing coil in response to an output of the multiplying circuit. In accordance with the degaussing apparatus thus constructed, the attenuation curve signal previously stored and the sine wave signal are multiplied and the driving circuit drives a degaussing coil in response to the multiplied result. Therefore, the degaussing operation can be effected constantly at a constant timing and by a current corresponding to a current flowing through a posistor in actual practice.

The above and other objects, features, and advantages of the present invention will become apparent from the following detailed description of an illustrative embodiment thereof to be read in conjunction with the accompanying drawings, in which like reference numerals are used to identify the same or similar parts in the several views.

DETAILED DESCRIPTION OF THE PREFERRED EMBODIMENT

A degaussing apparatus according to an embodiment of the present invention will now be described with reference to the drawings.

Figure 6:
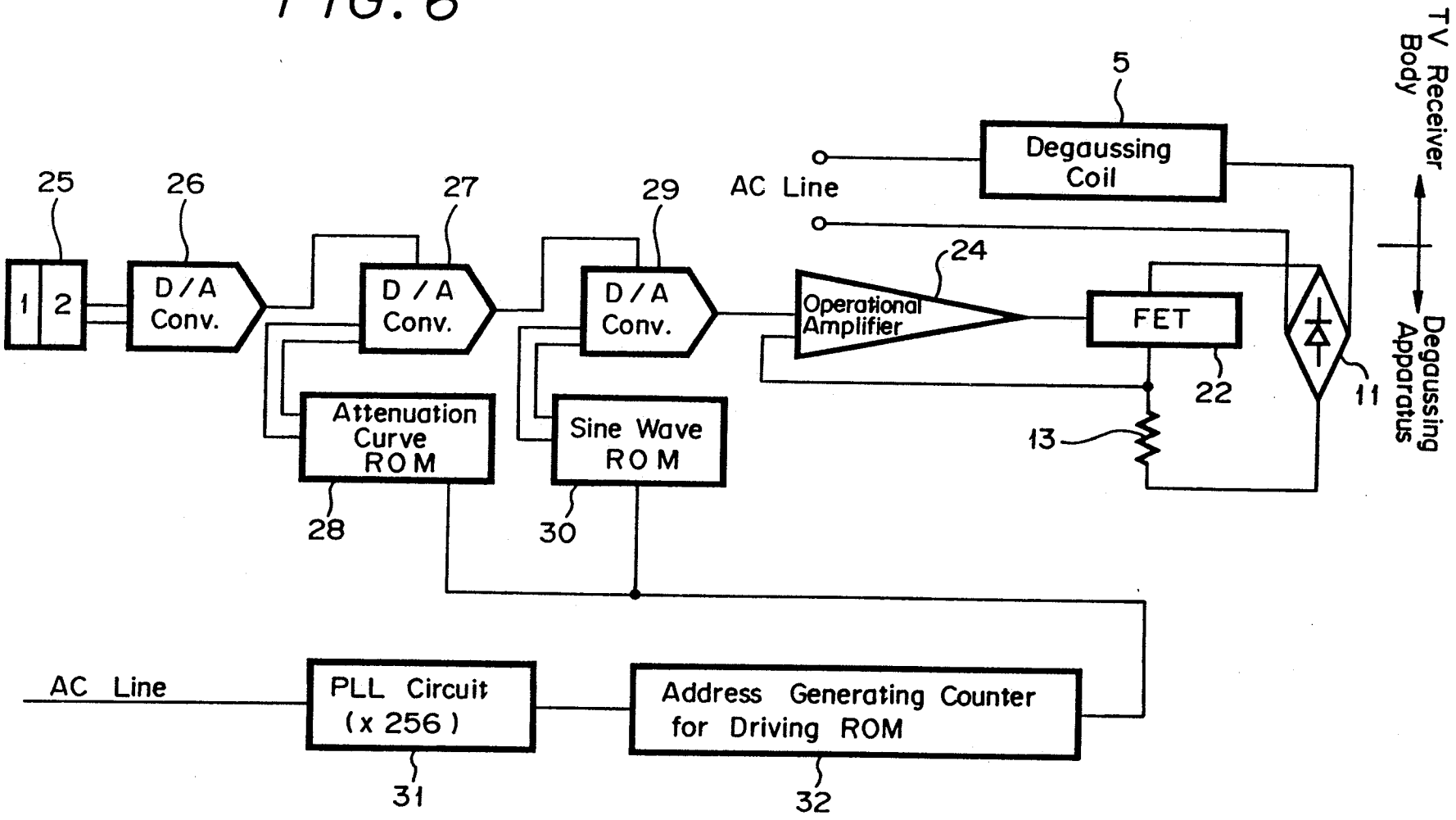
FIG. 6 is a block diagram showing a degaussing apparatus according to an embodiment of the present invention.

FIG. 6 of the accompanying drawings shows in block form an arrangement of an embodiment of a degaussing apparatus according to the present invention. In FIG. 6, like parts corresponding to those of the aforementioned prior art are marked with the same references and therefore need not be described in detail.

Figure 5:
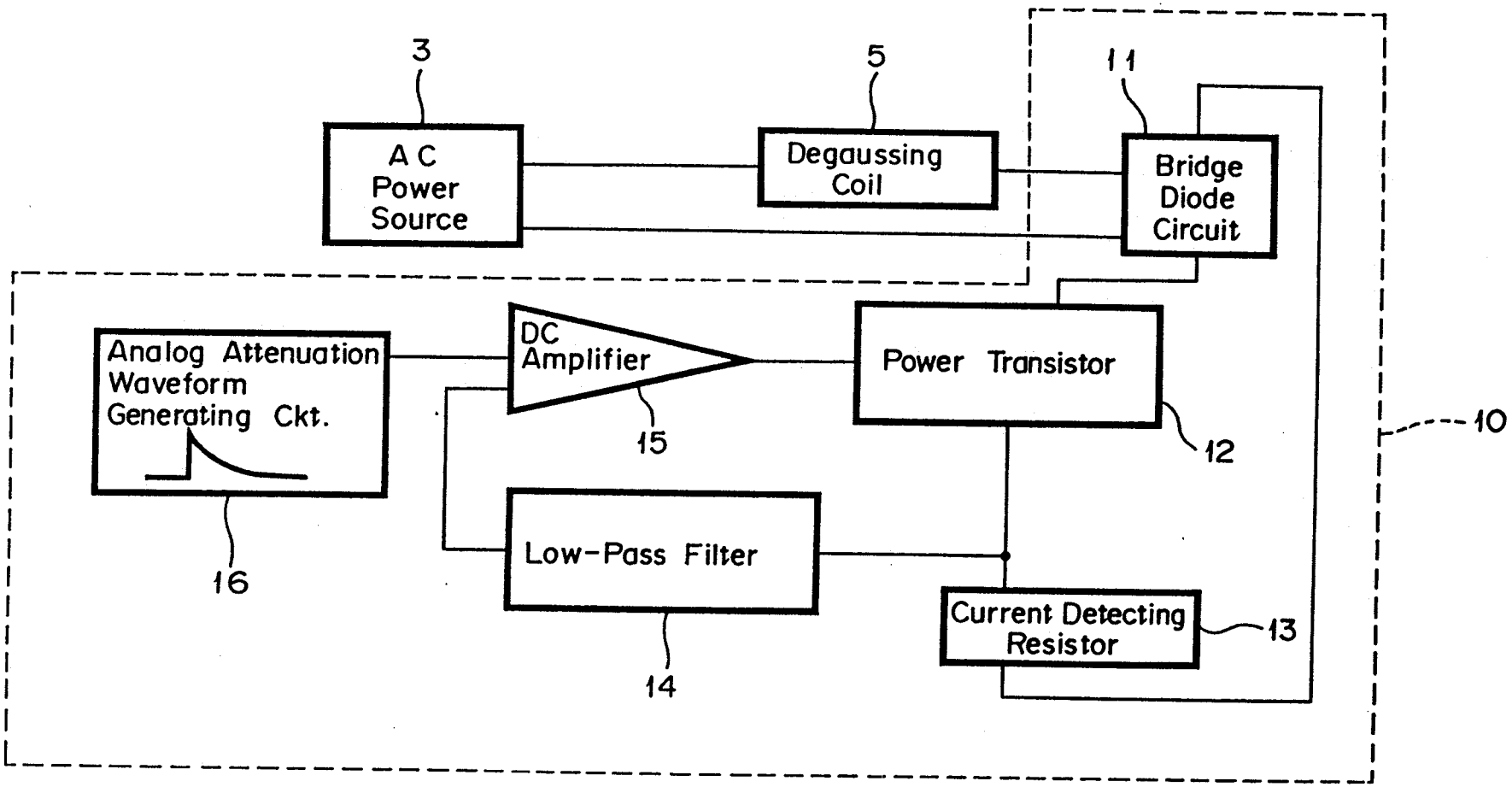
FIG. 5 (PRIOR ART)
FIG. 5 is a block diagram showing an arrangement of a second example of a conventional degaussing apparatus used in a production line.

In this embodiment, similarly to FIG. 5, the diode bridge circuit 11 is coupled to the degaussing coil 5. The diode bridge circuit 11 is driven by a field effect transistor (FET) 22. An output of the current detecting resistor 13 is fed back to an operational amplifier 24 which drives the FET 22. The operational amplifier 24, the power FET 22 and the current detecting resistor 13 constitute an attenuating constant current circuit.

A value (rush current) set by a current setting switch 25 is input to a digital-to-analog (D/A) converter 26, and an output of the D/A converter 26 is input to a D/A converter 27 at the next stage as a reference voltage. The D/A converter 27 is supplied at its input with a signal (digital data) of an attenuation curve stored in a read-only memory (ROM) 28. An output of the D/A converter 27 is supplied to a D/A converter 29 at the next stage as a reference signal and a sine wave signal (digital data) stored in a ROM 30 also is supplied to the D/A converter 29.

A phase-locked loop (PLL) circuit 31 multiplies a signal having a frequency of 50 Hz or 60 Hz from an AC power source (not shown) by 256 to thereby generate a clock. An address generating counter 32 counts the clock input from the PLL circuit 31 to generate an address corresponding to the count value and outputs the same to the ROMs 28 and 30.

Operation of the degaussing apparatus according to the present invention will be described hereinafter.

Digital data corresponding to the desired rush current is set by the current setting switch 25 and this digital data is input to the D/A converter 26. The D/A converter 26 converts the data input thereto by the current setting switch 25 in the form of digital to analog signal and outputs the analog signal thus converted to the D/A converter 27 of the next stage as a reference voltage. The ROM 28 stores therein in a digital fashion the signal of the attenuation curve corresponding to the attenuation current provided when the posistor 4 is operated. The digital data corresponding to the attenuation curve read out from the ROM 28 is input to the D/A converter 27, in which it is substantially multiplied with the voltage input thereto from the D/A converter 26 of the preceding stage, thereby being converted in the form of digital to analog signal. Accordingly, the value of the rush current output from the D/A converter 27 is adjusted to become the value set by the current setting switch 25.

The signal of attenuation curve output from the D/A converter 27 is input to the D/A converter 29 at the next stage as a reference voltage. The sine wave signal from the ROM 30 also is input to the D/A converter 29. The digital data of the sine wave signal stored in the ROM 30 is recorded therein as a waveform provided when the sine wave signal is full-wave-rectified. More specifically, an envelope of a waveform, which results from full-wave-rectifying the attenuation current of the posistor 4, is recorded in the ROM 28, while a full-wave-rectified waveform of the sine wave is recorded in the ROM 30. The D/A converter 29 substantially multiplies the digital data of the sine wave input thereto from the ROM 30 with the voltage input thereto from the D/A converter 27, for thereby converting this digital signal into an analog signal.

A signal output from the D/A converter 29 is input to the operational amplifier 24 to drive the FET 22 so that, when the positive half wave is input to the AC line, for example, a current is flowed through a loop formed of the AC line, the degaussing coil 5, the diode bridge circuit 11, the FET 22, the current detecting resistor 13, the diode bridge circuit 11 and the AC line, in that order. Also, when the negative wave is input to the AC line, a current is flowed through the loop of the AC line, the diode bridge circuit 11, the FET 22, the current detecting circuit 13, the diode bridge circuit 11, the degaussing circuit 5 and the AC line, in that order. A voltage corresponding to the above current is detected by the current detecting resistor 13 and then fed back to the operational amplifier 24. As a consequence, the degaussing current flowed through the degaussing coil 5 is servo-controlled so as to coincide with the reference waveform previously stored and set in the ROMs 28 and 30.

The address generating counter 32 counts the clock input thereto from the PLL circuit 31 in synchronism with a zero cross point of the AC line. To be more concrete, the address generating counter 32 starts incrementing the count value of the clock from a timing point whereat the signal of the AC line crosses the zero point so that the signals output from the D/A converters 27 and 29 are constantly started in synchronism with the zero cross point of the AC line. Therefore, the timing (phase) of the voltage supplied to the degaussing coil 5 from the AC line and the timing (phase) of the control voltage input to the control voltage terminal from the FET 22 are constantly kept in a constant relation, thereby making it possible to constantly reproduce a constant degaussing effect.

Incidentally, many waveforms corresponding to a variety of video apparatus can be previously stored in the ROMs 28 and 30.

Figure 1:
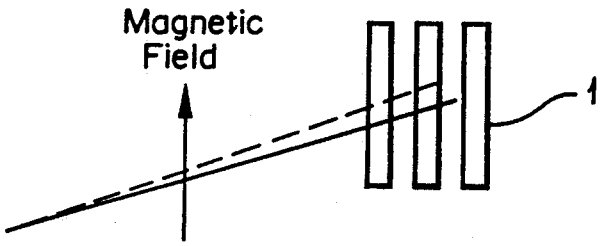
FIG. 1 (PRIOR ART)
FIG. 1 is a schematic diagram used to explain an influence exerted upon an electron beam by terrestrial magnetism.
Figure 2:
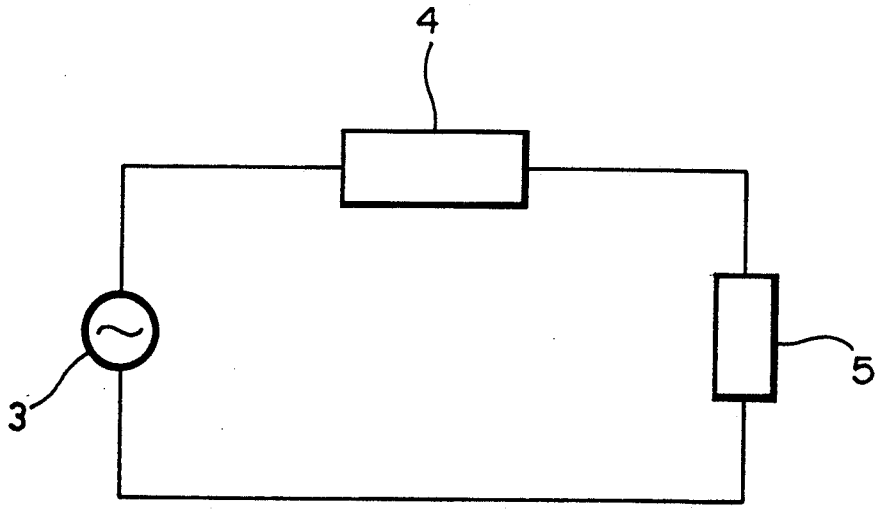
FIG. 2 (PRIOR ART)
FIG. 2 is a block diagram showing an arrangement of an example of a conventional degaussing apparatus incorporated in a television receiver.
Figure 3:
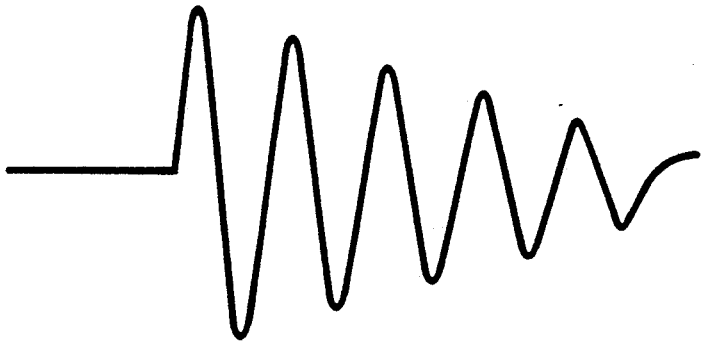
FIG. 3 (PRIOR ART)
FIG. 3 is a waveform diagram showing an example of a degaussing current flowing through the degaussing coil 5 shown in FIG. 2.
Figure 4:
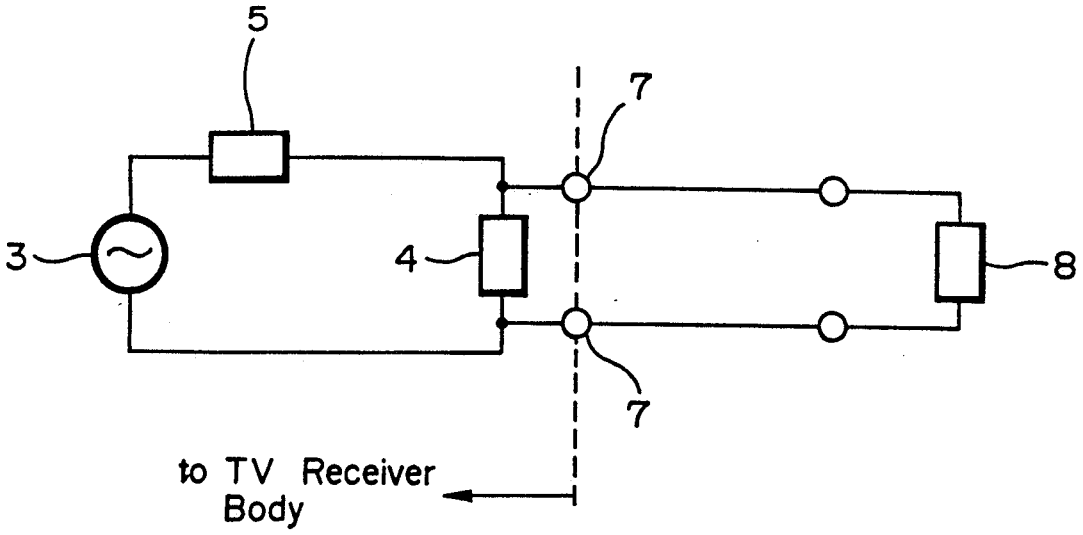
FIG. 4 (PRIOR ART)
FIG. 4 is a block diagram showing an arrangement of a first example of a conventional degaussing apparatus used in a production line.

While the diode bridge circuit 11 is directly coupled to the degaussing coil 5 as described above, the diode bridge circuit 11 may be coupled to the posistor 4 incorporated within the television receiver similarly to the external posistor 8 shown in FIG. 4.

According to the present invention, since the power FET is employed as the degaussing current control element, a secondary breakdown phenomenon can be avoided unlike the conventional transistor system, which can provide a highly reliable degaussing apparatus. Further, since the control current is not required, the control circuit can be simplified in configuration, which can reduce the power consumption and which can also simplify the driving circuit in arrangement. Furthermore, since the rush current is set by the current setting switch in a digital fashion, the value of the rush current can be set freely with ease.

In addition, since the degaussing apparatus of the present invention employs the current feedback system, even when the voltage of the AC power source is different, the circuit need not be modified.

As set out above, according to the degaussing apparatus of the present invention, since the attenuation curve signal and the sine wave signal stored in the memory means are multiplied to thereby drive the degaussing coil, the following effects can be achieved:

(1) Since this degaussing apparatus is designed such that the attenuation curve signal is read out from the memory means, an arbitrary pattern can be selected from many patterns and utilized, for thereby reducing a degaussing time necessary for achieving the same degaussing effect. Therefore, the productivity can be increased in the production line. Whereas, if the posistor is employed, a current must be flowed during a predetermined period of time in order for the posistor to present a predetermined resistance value and then the degaussing operation becomes possible, whereby a duration of one cycle for performing the degaussing operation is unavoidably increased.

(2) Since the sine wave (half wave) signal is read out from the memory means and then multiplied with the attenuation curve signal to control the current flowing through the degaussing coil by the resultant waveform signal, it is possible to generate the degaussing current having less distortion.

(3) The timing and the zero cross point of the AC power source, for example, can be made coincident with each other so that, even when the degaussing apparatus is repeatedly operated, a constant degaussing effect can be reproduced constantly.

Having described the preferred embodiment of the invention with reference to the accompanying drawings, it is to be understood that the invention is not limited to that precise embodiment and that various changes and modifications thereof could be effected by one skilled in the art without departing from the spirit or scope of the invention as defined in the appended claims.

What is claimed is:

1. A degaussing apparatus comprising:

(a) first memory means for storing therein a signal of an attenuation curve;

(b) second memory means for storing a signal of a sine wave;

(c) multiplying means for multiplying said signal of attenuation curve output from said first memory means and said sine wave signal output from said second memory means; and (d) driving means for driving a degaussing coil in response to an output of said multiplying means.

2. The degaussing apparatus according to claim 1, in which said first and second memory means are each formed of a read-only memory (ROM).

3. The degaussing apparatus according to claim 1, in which said multiplying means is a digital-to-analog (D/A) converter.

4. The degaussing apparatus according to claim 3, further comprising a current setting switch for setting digital data corresponding to a desired rush current.

5. The degaussing apparatus according to claim 1, in which said driving means includes an operational amplifier.

6. The degaussing apparatus according to claim 4, in which said driving means includes a field effect transistor (FET).

7. The degaussing apparatus according to claim 1, further comprising a phase-locked loop (PLL) circuit supplied with a signal from an AC power source and generating a clock, and an address generating counter supplied with the clock from said phase-locked loop circuit and generating an address which is supplied to said first and second memory means.

* * * * *